US007530316B2

(12) United States Patent
Blohm et al.

(10) Patent No.: US 7,530,316 B2
(45) Date of Patent: May 12, 2009

(54) METHOD FOR DETECTING AND NEUTRALIZING SUBMARINE OBJECTS

(75) Inventors: Christian Blohm, Cuxhaven (DE); Dirk Neumeister, Stuttgart (DE)

(73) Assignee: Atlas Elektronik GmbH, Bremen (DE)

( * ) Notice: Subject to any disclaimer, the term of this patent is extended or adjusted under 35 U.S.C. 154(b) by 166 days.

(21) Appl. No.: 11/667,788

(22) PCT Filed: Dec. 1, 2005

(86) PCT No.: PCT/EP2005/012790

§ 371 (c)(1),
(2), (4) Date: May 15, 2007

(87) PCT Pub. No.: WO2006/072296

PCT Pub. Date: Jul. 13, 2006

(65) Prior Publication Data

US 2008/0257140 A1 Oct. 23, 2008

(30) Foreign Application Priority Data

Dec. 23, 2004 (DE) ..... 10 2004 062 122

(51) Int. Cl.
*F42B 19/00* (2006.01)
*B63G 8/14* (2006.01)
*B63G 9/00* (2006.01)

(52) U.S. Cl. ..... 102/402; 102/403; 89/1.13; 114/331

(58) Field of Classification Search ..... 102/402, 102/403; 89/1.13; 114/330, 331, 332
See application file for complete search history.

(56) References Cited

U.S. PATENT DOCUMENTS 4,972,388 A * 11/1990 Kirkland ..... 367/131
4,972,776 A * 11/1990 Shumaker et al. ..... 102/402
5,370,074 A 12/1994 Knudsen et al.
5,598,152 A * 1/1997 Scarzello et al. ..... 340/850
5,844,159 A * 12/1998 Posseme et al. ..... 89/1.13

(Continued)

FOREIGN PATENT DOCUMENTS

EP 0612656 10/1997

(Continued)

*Primary Examiner*—Bret Hayes
(74) *Attorney, Agent, or Firm*—Fitch, Even, Tabin & Flannery; Norman N. Kunitz

(57) ABSTRACT

In a method for detection and neutralization of underwater objects which are present in a sea region, in particular mines, a two-dimensional or three-dimensional image of the seabed is created by means of an unmanned first underwater vehicle during a reconnaissance mission in a sea region section by means of optical and/or acoustic sensors, and this image is evaluated for the presence of underwater objects, after completion of the reconnaissance mission. At least one underwater object which is present is marked in the image, and the image which has been provided with the object marking is stored in an unmanned second underwater vehicle, which is equipped with the same sensors and additionally with a neutralization unit. During a neutralization mission by the second underwater vehicle in the same sea region section, image elements of the seabed are created continuously by means of the sensors and are compared with the stored image of the seabed. The second underwater vehicle is guided to the marked underwater object on the basis of the comparison data, and activates the neutralization unit there.

8 Claims, 1 Drawing Sheet

U.S. PATENT DOCUMENTS

| | | | | |
|---|---|---|---|---|
| 6,058,847 | A * | 5/2000 | Adams | 102/402 |
| 6,802,236 | B1 * | 10/2004 | Richardson | 89/1.13 |
| 2003/0159573 | A1 * | 8/2003 | Cangelosi | 89/1.13 |
| 2004/0055450 | A1 * | 3/2004 | Cangelosi | 89/1.13 |

FOREIGN PATENT DOCUMENTS

| | | |
|---|---|---|
| FR | 2832975 | 6/2003 |
| WO | WO 92/00220 | 1/1992 |

* cited by examiner

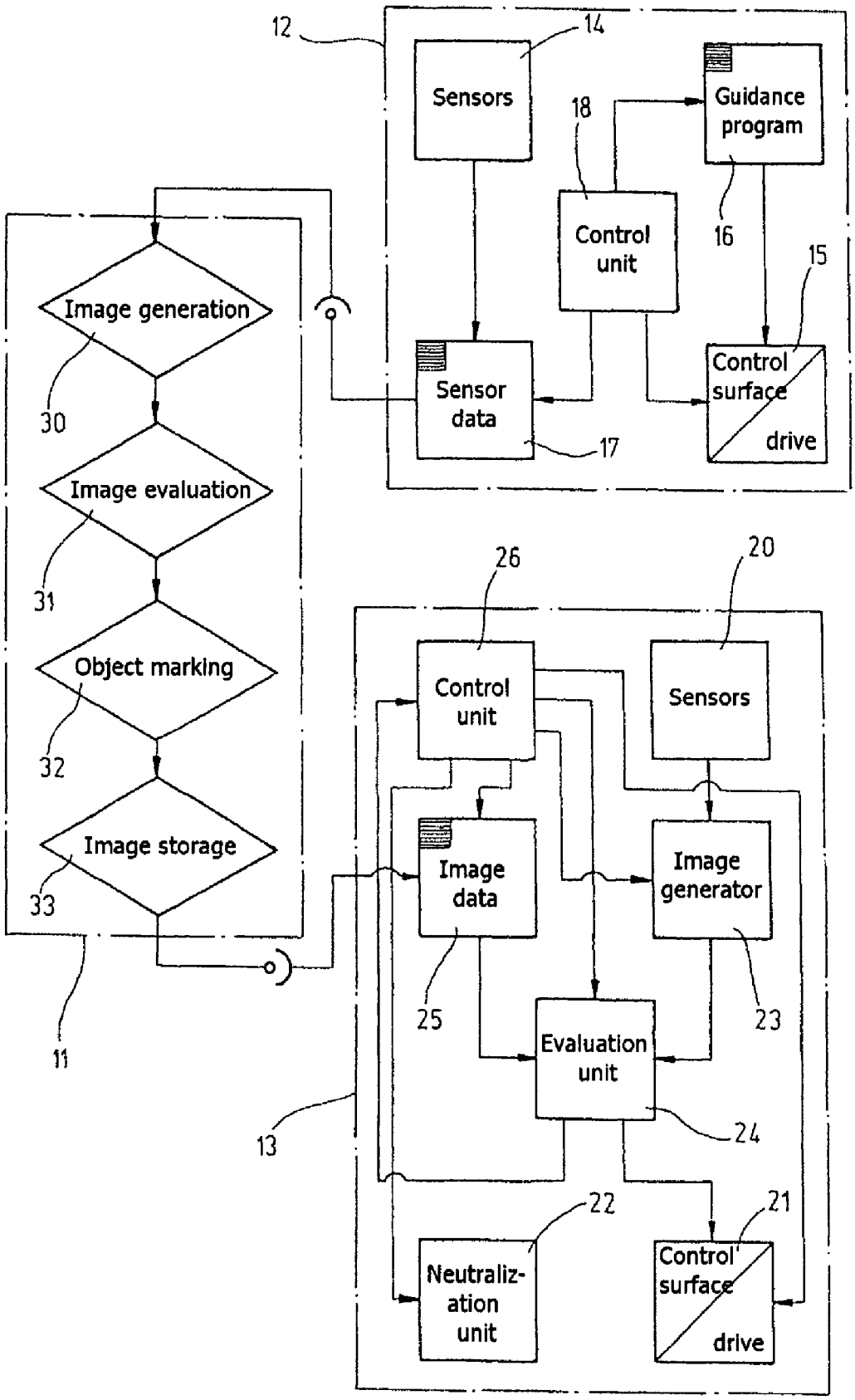
12
14
Sensors
18
Guidance program
Control unit
16
15
Image generation
Sensor data
Control surface drive
30
17
Image evaluation
31
26
20
Object marking
Control unit
Sensors
32
Image storage
Image data
Image generator
33
25
23
Evaluation unit
11
13
24
22
21
Neutraliz-ation unit
Control surface drive

METHOD FOR DETECTING AND NEUTRALIZING SUBMARINE OBJECTS

CROSS REFERENCE TO RELATED APPLICATION

This application is the National Stage filing under 35 U.S.C. 371 of International Application No. PCT/EP2005/012790 filed Dec. 1, 2005, and claims priority of German Patent Application 10 2004 062 122.5, filed Dec. 23, 2004, the subject matter of which, in their entireties, is incorporated herein by reference.

BACKGROUND OF THE INVENTION

The invention relates to a method for detection and neutralization of underwater objects which are present in a sea region, in particular mines, of the generic type defined in the precharacterizing clause of Claim 1.

In a known method for detection and destruction of mines (EP 0 535 044 B1), an unmanned, remotely controlled underwater vehicle, a so-called ROV, as well as a remotely controlled search and mine destruction unit, which is equipped with an explosive charge for mine destruction, are used, and are connected to one another by means of a glass fibre cable. The ROV is connected via a further glass fibre cable to a surface vessel which has a sonar system for detection and location of mines. The mine and search unit is also equipped with a transponder, acoustic sensors such as a short-range sonar, with optical sensors such as a TV camera with an illumination unit, and with sensors for measurement of actual data for navigation, such as the direction of travel, the angle with respect to the horizontal plane, the distance from the seabed and the diving depth. The transponder corresponds with an acoustic positioning system (APS), whose hydrophones are arranged on the ROV. The ROV has an ejection unit, a so-called launcher, to which the search and mine destruction unit is subject. The search and mine destruction unit is guided by means of the APS by an operator, who is positioned in the surface vessel, to the sonar beam, which is directed at the mine, from the mine hunting sonar. The search and mine destruction unit, whose transponder signals are displayed on the mine hunting sonar together with the mine echo signals, is then controlled towards the mine by the operator in the sonar beam from the mine hunting sonar. The mine is checked by means of the TV camera, and the search and mine destruction unit is moved by the operator to a position with respect to the mine which is advantageous for destruction, and is then remotely detonated by the operator. The exploding explosive charge of the search and mine destruction unit which, for example, may be a shaped charge, causes the mine to be detonated, with the search and mine destruction unit also being destroyed.

The invention is based on the object of specifying a method of the type mentioned initially, by means of which a sea region, in particular a coastal region, can be searched quickly and efficiently for underwater objects which are present, in particular mines, and can be cleared of these objects.

According to the invention, the object is achieved by the features of Claim 1.

The method according to the invention has the advantage that the reconnaissance mission and the neutralization mission are carried out separately by an unmanned underwater vehicle in each case, so that the neutralization mission can be assigned to a very precisely located object. If more than one object is found in the reconnaissance image, neutralization missions can be carried out in parallel by different underwater vehicles at the same time, so that the time to clear the sea region is considerably shortened. During the neutralization mission, the shortest route to the assigned object can be found quickly, and the assigned object can also be reliably identified on the basis of an image comparison between the stored image, in which the assigned object is marked, with the image elements which are produced continuously by the sensors during the movement of the underwater vehicle. There is no need for any navigation device, for example a direct-reckoning navigator, to preset the track of the underwater vehicle which is moving autonomously in the neutralization mission. In particular, the underwater vehicles for neutralization can operate well away from any manned mission control centre, for example a surface vessel for coordination of the missions to be carried out, so that the mission control centre is not subjected to any danger, in particular for mine clearance purposes. The underwater vehicle can, in particular, enter coastal regions without any problem which cannot be approached and cleared by conventional mine clearance vehicles.

Expedient embodiments of the method according to the invention together with advantageous developments and refinements of the invention are specified in the further claims.

The invention will be described in more detail in the following text on the basis of an exemplary embodiment which is illustrated in the drawing. In this case, the drawing shows block diagrams of the components which are required for the method in a reconnaissance drone and in a neutralization drone, as well as a procedure of method steps which are carried out in a mission control centre.

In the drawing, 11 denotes a mission control centre, for example a surface vessel or a submarine, from which the mine search and clearance in a sea region is coordinated. The sea region being approached is subdivided in the mission control centre 11 into detection and clearance sections, referred to in the following text as sea region sections, in which reconnaissance and clearance missions are carried out successively or in parallel. The mission control centre 11 itself remains well away from the sea region assigned for clearance throughout the entire operation, so that it is never endangered.

12 denotes a first unmanned, autonomously acting underwater vehicle, which carries out a reconnaissance mission and is referred to in the following text as a reconnaissance drone. 13 denotes a second unmanned, autonomously acting underwater vehicle, which carries out a neutralization mission, that is to say mine destruction in the case of the mine clearance operation described here, and this is referred to in the following text as a neutralization drone. The reconnaissance drone 12 has optical and/or acoustic sensors 14, such as a high-resolution camera or a short-range sonar, which is operated in the side-looking mode or in the forward-looking mode, or else a parametric sonar or a sediment echo sounder, as well as a sensor data memory 17 for storage of the data produced by the sensors. The reconnaissance drone 12 normally has a drive and control-surface device 15, which is controlled by means of a guidance program that is stored in a guidance program memory 16. All of the components are actuated in the correct sequence by a central control unit 18.

The neutralization drone 13 has the same sensors 20 as the reconnaissance drone 12, and likewise has a drive and control-surface device 21 and, in addition, a neutralization unit 22, for example an explosive charge or mine destruction charge. The data produced by the sensors 20 is supplied to an image generator 23, which is followed by an evaluation unit 24 whose input side is still connected to a memory 25 for image data storage. All of the components in the neutralization drone 13 are actuated in the correct sequence by a central control unit 26.

Any mines in the assigned sea region are detected and neutralized by these two unmanned, autonomously operating underwater vehicles in accordance with the following method:

The reconnaissance drone 12 and the neutralization drone 13 are transported by the mission control centre 11, preferably in large numbers, and are used as required. After definition of a sea region section, a specific guidance program is stored in the guidance program memory 16 in the reconnaissance drone 12, on the basis of which the reconnaissance drone 12 is intended to move systematically over the sea region section. In order to carry out a reconnaissance mission, the reconnaissance drone 12 is placed in the water from the mission control centre 11 and moves through the sea region section in accordance with the predetermined guidance program. The sensors 14 scan the seabed in the sea region section, and produce sensor data continuously, from which a two-dimensional or three-dimensional image of the seabed can be created. If a short-range sonar or a high-resolution camera is used as a sensor 14, then the resultant image shows the topography of that sea region section. If a sediment echo sounder or a parametric sonar is used as a sensor 14, then an image of the bed characteristic of the seabed down to a bed depth which is predetermined by the penetration depth of the sensors is created in addition to the topography. All of the sensor data is stored in the sensor data memory 17.

After completion of the reconnaissance mission, the reconnaissance drone 12 returns to the mission control centre 11 where the sensor data is read from the control data memory 27, and the two-dimensional or three-dimensional image of the seabed in the sea region section is created from the sensor data (image generation 30). As already mentioned, the image shows either the topography or the topography and the bed characteristic of the seabed in the sea region section. The generated image is now evaluated for the presence of underwater objects, in the described exemplary embodiment mines (image evaluation 31). One underwater object is selected from the identified objects, and is marked in the image (object marking 32). The image provided with the object marking is written to the image data memory 25 in the reconnaissance drone 12 (image storage 33). If the image contains a plurality of underwater objects, then a further underwater object can be marked in the image, and the image with this object marking is written to the image memory 25 in a second reconnaissance drone 12.

The neutralization drone 13 that has been prepared in this way is placed in the water from the mission control centre 11, and is started to carry out the neutralization mission. During the neutralization mission, image elements of the seabed are created continuously in the neutralization drone 13 by means of the sensors 20, for which purpose the sensor data produced by the sensors 20 is supplied to the image generator 23, in which image elements are created continuously which correspond to those sections of the image that is stored in the image data memory 25 which the neutralization drone 13 is in each case moving through. The image elements created in the image generator 23 are continuously compared in the evaluation unit 24 with the image stored in the image data memory 25, and the comparison data is used to determine guidance data, which is supplied to the control-surface device 21. The neutralization drone 13 is guided to the underwater object by these guidance signals.

When the neutralization drone 13 has arrived at the underwater object, as is likewise identified by comparison of the image element created by the image generator 23 of the area surrounding the object with the image stored in the image data memory 25, the central control unit 18 activates the neutralization unit 22, for example an integrated explosive charge, which causes the mine to explode, and thus destroys it.

Alternatively, the neutralization unit in the neutralization drone 13 may also be a tool which is used, for example, to sever the tether of anchored tethered mines, which then float up and can be cleared on the water surface.

In a modification of the described exemplary embodiment, the image generation process which is carried out in the mission control centre 11 can be carried out instead in the reconnaissance drone 12, so that the reconnaissance drone 12 itself produces a two-dimensional or three-dimensional image of the seabed of the sea region section that has been moved over, and the image then just has to be evaluated for the presence of mines in the mission control centre 11.

Instead of the autonomously acting reconnaissance drone 12, it is also possible to use a reconnaissance drone which is remotely guided from the mission control centre 11, for example a wire-guided reconnaissance drone, which, with the exception of the guidance program memory, has the same components.

The invention claimed is:

1. Method for detection and neutralization of underwater objects which are present in a sea region, in particular mines, using at least one unmanned underwater vehicle which is equipped with optical and/or acoustic sensors, characterized by the following method steps:

during a reconnaissance mission by the underwater vehicle in a sea region section, a two-dimensional or three-dimensional image of the seabed is created by means of the sensors in the underwater vehicle, after conclusion of the reconnaissance mission, the image is evaluated for the presence of underwater objects and at least one underwater object that is present in the image is marked, the image that has been provided with at least one underwater object marking is stored in at least one second underwater vehicle, which is equipped with the same sensors as the first underwater vehicle and additionally with a neutralization unit, during a neutralization mission by the second underwater vehicle in the same sea region section, image elements of the seabed are created continuously by means of the sensors in the second underwater vehicle, and are compared with the stored image, the second underwater vehicle is guided to the marked underwater object on the basis of the comparison data, and the neutralization unit is activated at the location of the underwater object.

2. Method according to claim 1, characterized in that the topography of the seabed and/or the bed characteristic of the seabed down to a predetermined bed depth are/is recorded as an image of the seabed.

3. Method according to claim 2, characterized in that at least one high-resolution camera is used as optical sensors, and a short-range sonar and/or sediment echo sounder or a parametric sonar is used as acoustic sensors.

4. Method according to claim 3, characterized in that the short-range sonar is operated in the side-looking mode or in the forward-looking mode.

5. Method according to claim 1, characterized in that an explosive charge which is carried in the second underwater vehicle is used as the neutralization unit.

6. The method according to claim 5, characterized in that the explosive charge is integrated in the second underwater vehicle.

7. Method according to one of claim 1, characterized in that a tool which is arranged on the second underwater vehicle is used as the neutralization unit.

8. Method according to claim 1, characterized in that the first underwater vehicle is remotely controlled or is operated autonomously during the reconnaissance mission, and the at least second underwater vehicle is operated autonomously during the neutralization mission.

* * * * *